US008435088B2

(12) United States Patent
Morettin et al.

(10) Patent No.: US 8,435,088 B2
(45) Date of Patent: May 7, 2013

(54) TRIM AND TILT APPARATUS

(75) Inventors: Mike Morettin, Delta (CA); Mike Ure, Delta (CA); Ryan Rowe, Bumaby (CA); Peter Spindloe, North Vancouver (CA)

(73) Assignee: Marine Canada Acquisition Inc., Richmond (CA)

( * ) Notice: Subject to any disclaimer, the term of this patent is extended or adjusted under 35 U.S.C. 154(b) by 326 days.

(21) Appl. No.: 12/477,749

(22) Filed: Jun. 3, 2009

(65) Prior Publication Data

US 2009/0305586 A1 Dec. 10, 2009

Related U.S. Application Data

(60) Provisional application No. 61/058,860, filed on Jun. 4, 2008.

(51) Int. Cl.
*B63H 5/125* (2006.01)

(52) U.S. Cl.
USPC ..... 440/61 T; 440/53

(58) Field of Classification Search ..... 440/53, 440/61 D, 61 R, 61 T, 61 F
See application file for complete search history.

(56) References Cited

U.S. PATENT DOCUMENTS

| | | | |
|---|---|---|---|
| 4,545,770 | A | 10/1985 | Ferguson |
| 4,720,278 | A | 1/1988 | Taguchi et al. |
| 4,764,134 | A | 8/1988 | Watanabe |
| 5,032,094 | A | 7/1991 | Katogi |
| 5,597,333 | A | 1/1997 | Soda |
| 6,071,157 | A | 6/2000 | Yoshino et al. |
| 6,824,435 | B2 | 11/2004 | Divisi |
| 6,837,761 | B2 | 1/2005 | Saito |
| 7,001,230 | B2 | 2/2006 | Saito |
| 7,104,854 | B2 | 9/2006 | Saito |
| 7,128,625 | B2 | 10/2006 | Saito |
| 7,147,524 | B2 | 12/2006 | Saito |
| 7,150,663 | B2 | 12/2006 | Saito |
| 7,407,420 | B2 | 8/2008 | Fetchko et al. |

FOREIGN PATENT DOCUMENTS

| | | |
|---|---|---|
| JP | 4251959 | 5/2005 |

*Primary Examiner* — Lars A Olson
(74) *Attorney, Agent, or Firm* — Cameron IP

(57) ABSTRACT

A trim and tilt system comprises a trim cylinder unit including a trim cylinder and a trim rod reciprocatingly received by the trim cylinder. The trim rod has a chamfer at distal end thereof. A trim receiver mounted on a swivel bracket has a curved, three-dimensional surface for applying a force to the trim rod. The curved, three-dimensional surface of the trim receiver and the distal end of trim rod are able to self-align so that the force applied to the trim rod is applied substantially along a longitudinal axis of the trim rod.

10 Claims, 9 Drawing Sheets

TRIM AND TILT APPARATUS

CROSS-REFERENCE TO RELATED APPLICATION

This application claims the benefit of provisional application 61/058,860 filed in the United States Patent and Trademark Office on Jun. 4, 2008, the complete disclosure of which is incorporated herein by reference and priority to which is claimed.

BACKGROUND OF THE INVENTION

1. Field of the Invention

The present invention relates to a trim and tilt system for use with a propulsion unit mounted on a marine craft.

2. Description of Related Art

Conventional trim and tilt systems include a unitary trim and tilt cylinder apparatus, as disclosed in U.S. Pat. No. 5,032,094, issued Jul. 16, 1991 to Sadaji Katogi, hereinafter Katogi. Katogi discloses a trim and tilt system for trimming and tilting an outboard propulsion unit mounted on a marine craft. The trim and tilt system disclosed by Katogi includes a unitary trim and tilt cylinder apparatus having a tilt cylinder unit and a trim cylinder unit; a stern bracket configured to be mounted on the transom of the marine craft; a swivel bracket for supporting the outboard propulsion unit; the swivel bracket being pivotally supported on an upper end of the stern bracket; and a hydraulic fluid circuit for actuating the tilt cylinder unit and the trim cylinder unit. The trim and tilt cylinder apparatus has an upper end pivotally supported on the stern bracket and a lower end pivotally supported on the swivel bracket.

In the trim and tilt system disclosed by Katogi undue stress may be applied to the trim cylinder units at points of contact between the trim rods and the swivel bracket. This excessive stress is in part due to the unitary construction of the trim and tilt cylinder apparatus. As the outboard propulsion unit pivots during the trimming phase, the angle of the trim rods changes with respect to the swivel bracket. The weight of the propulsion unit is therefore applied to the trim rods at various angles throughout the trimming phase. This may lead to a considerable amount of transverse stress being applied to the trim rods and their respective trim cylinders which, in turn, may lead to undue wear and fatigue.

SUMMARY OF THE INVENTION

It is an object of the present invention to provide an improved trim and tilt system which reduces the stress experienced by trim cylinder units during the trimming of a marine propulsion unit.

There is accordingly provided a trim and tilt system for use with a propulsion unit and a marine craft. The trim and tilt system includes a stern bracket for mounting the trim and tilt system on the marine craft. A swivel bracket is pivotably connected to the stern bracket. The swivel bracket supports the propulsion unit. A tilt cylinder unit is connected to the swivel bracket. The tilt cylinder unit includes a tilt cylinder and a tilt rod reciprocatingly received by the tilt cylinder. A trim cylinder unit is pivotably coupled to the tilt cylinder unit. The trim cylinder unit has a trim rod reciprocatingly received by the tilt cylinder. The trim rod has at least one chamfer at a distal end thereof. A trim receiver is mounted on the swivel bracket. The trim receiver has a curved three dimensional surface for applying a force on the trim rod.

The trim receiver my be pivotably or rotatably mounted on the swivel bracket. The curved three dimensional surface may be a hyperboloid or paraboloid surface. The distal end of the trim rod may include a rounded surface which tapers towards the trim cylinder and a pair of spaced apart chamfers. The propulsion unit may be an outboard motor.

The trim and tilt system disclosed herein provides the advantage of allowing the curved three dimensional surface of the trim receiver and the distal end of the trim rod to self-align so that a force applied to the trim rod acts substantially along a longitudinal axis thereof.

BRIEF DESCRIPTION OF THE DRAWINGS

The present invention will be more readily understood from the following description of preferred embodiments thereof given, by way of example, with reference to the accompanying drawings, in which.

DETAILED DESCRIPTION OF THE PREFERRED EMBODIMENTS

Figure 1:
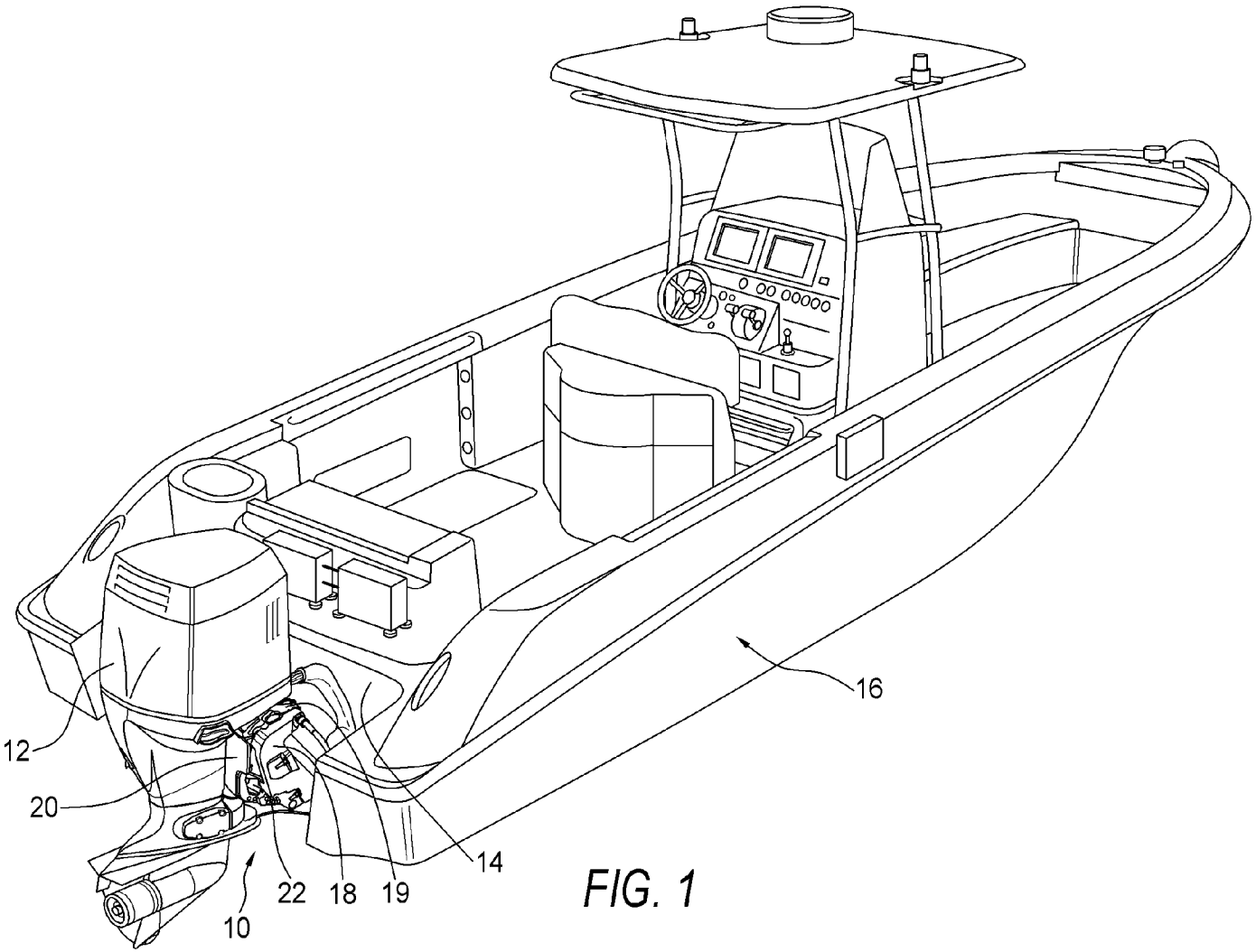
FIG. 1 is a perspective view of an improved trim and tilt system in an operative arrangement between a marine craft and a propulsion unit.

Referring to the drawings, and first to FIG. 1, this shows a trim and tilt system indicated generally by reference numeral 10. The trim and tilt system 10 is for trimming and tilting a propulsion unit 12 mounted on a transom 14 of a marine craft 16. In particular, the trim and tilt system 10 operates to move the propulsion unit 12 between a lower position and an upper position. The trim and tilt system 10 includes a stern bracket 18, a swivel bracket 20, and a trim and tilt cylinder apparatus 22. The stern bracket 18 is mounted on the transom 14 of the marine craft 16. A pivotal connection 19, in the form of a pivot shaft in this example, connects the swivel bracket 20 to the stern bracket 18. The swivel bracket 20 also supports the propulsion unit 12. The trim and tilt cylinder apparatus 22 has a bottom end supported by the stern bracket 14 and is pivotally connected at a top end with the swivel bracket 20. The propulsion unit 12 may be an outboard motor.

Figure 2:
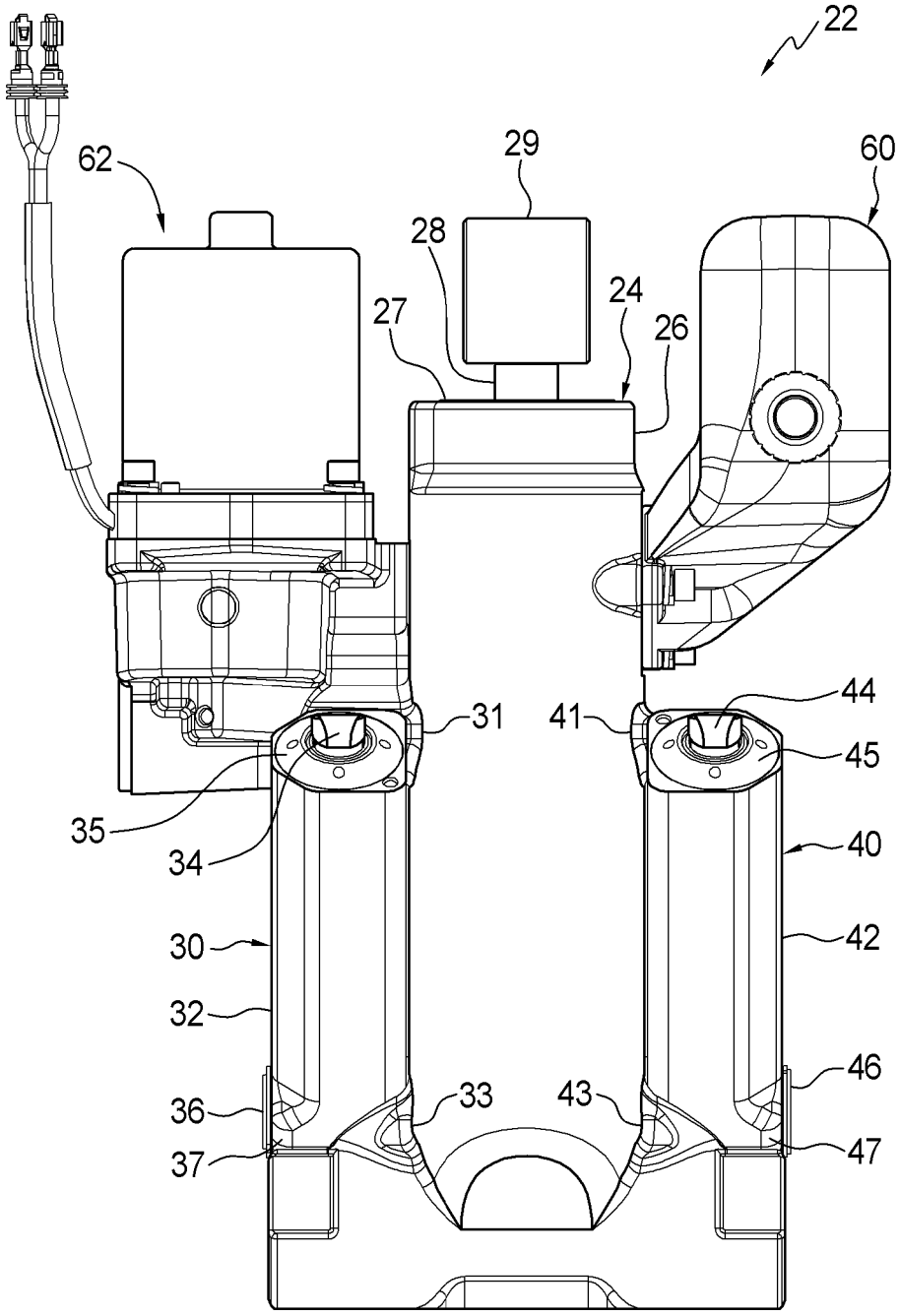
FIG. 2 is a front elevation view of a trim and tilt cylinder apparatus of the trim and tilt system of FIG. 1.

FIG. 2 shows the trim and tilt cylinder apparatus 22 in greater detail. The trim and tilt cylinder apparatus 22 includes a tilt cylinder unit 24 and at least one trim cylinder unit, of which there are two trim cylinder units 30 and 40 in this example. The trim cylinder units 30 and 40 are on opposite sides of the tilt cylinder unit 24 in this example.

The tilt cylinder unit 24 includes a tilt cylinder 26, a tilt rod 28 reciprocatingly received by the tilt cylinder 26, and a piston (not shown) disposed within the tilt cylinder 26. The piston is mounted on the tilt rod 28. The tilt rod 28 extends from a top 27 of the tilt cylinder 26. There is a clevis 29, in the form of an annular ring in this example, at a distal end of the tilt rod 28. A pivot rod (not shown) extends through the clevis 29 and pivotally connects the trim and tilt cylinder apparatus 22 to the swivel bracket 20.

The trim cylinder units 30 and 40 each include a trim cylinder 32 and 42 respectively. Trim rods 34 and 44 each reciprocatingly received by a corresponding one of the trim cylinders 32 and 42, and a piston (not shown) disposed within each of the trim cylinders 32 and 42. The pistons are mounted on the trim rods 34 and 44. The trim rods 34 and 44 extend from the tops 35 and 45 of the trim cylinders 32 and 42. As best shown in FIG. 2, the trim cylinder units 30 and 40 also have respective pivot pins 36 and 46 extending through bottoms 37 and 47 thereof. The pivot pins 36 and 46 are rotatably received by the tilt cylinder unit 24 and provide a pivotal connection between the tilt cylinder unit 24 and the corresponding trim cylinder units 30 and 40. In this example, the pivotal connections are independent of each other, allowing the trim cylinder units 30 and 40 to pivot independently. However this is not a requirement. The trim cylinder units 30 and 40 are mirror images of one another with like parts which function in a like manner. Accordingly, only one of the trim cylinder units 30 is described in detail herein.

The trim cylinder unit 30 is shown in greater detail in FIG. 6 to 9. A rounded distal end 39 of the trim rod 34 is defined by a truncated semi-cylindrical body 50. In particular, there are spaced apart chamfers 52 and 54 at opposite sides 56 and 58 of the truncated semi-cylindrical body 50. The chamfers 52 and 54 extend along axes which are generally perpendicular to a longitudinal axis 100 of the trim rod 34. Portions of the sides 56 and 58 of the truncated semi-cylindrical body 50 are also cut away so that a rounded surface 51 of the truncated semi-cylindrical body 50 tapers towards the trim cylinder 32.

Figure 7:
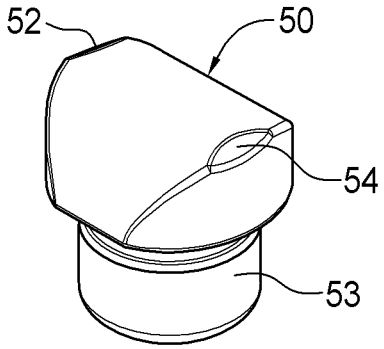
FIG. 7 is a top, front perspective view of a distal end of a trim rod of the trim cylinder unit of FIG. 6.
Figure 8:
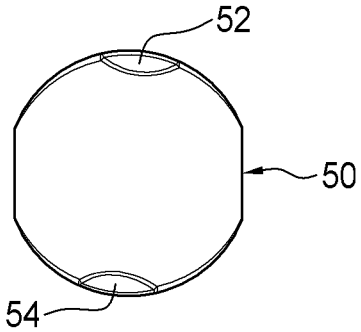
FIG. 8 is a top plan view of the distal end of the trim rod of FIG. 7.
Figure 9:
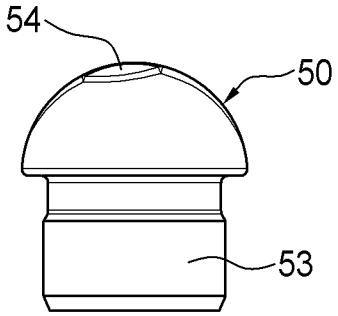
FIG. 9 is a side elevation view of the distal end of the trim rod of FIG. 7.

In this example, the truncated semi-cylindrical body 50 is machined separately from the trim rod 34. As best shown in FIGS. 7 to 9, the truncated semi-cylindrical body 50 is machined as a protuberance on a substantially annular or cylindrical base 53. The base 53 is then pressed into a bore (not shown) at an end of the trim rod 34. In other embodiments however the base and the end of the trim rod may be threadedly inter-engaged or machined as a unitary structure. Preferably the truncated semi-cylindrical body 50 is formed from bronze ore and, as best shown in FIG. 8, the chamfers 52 and 54 are off center and not aligned with each other.

Referring back to FIG. 2, pads 31 and 33 limit pivoting of the first trim cylinder unit 30 relative to the tilt cylinder unit 24. Similarly, pads 41 and 43 limit pivoting of the second trim cylinder unit 40 relative to the tilt cylinder unit 24. In this example, the pads are aluminum pads, but in other embodiments the pads may be resilient pads, e.g. non-linear springs, non-linear rubber bumpers, or polyurethane pads. The pads may also be in the form of inserts which can be installed and removed allowing for easy maintenance should the pads become damaged or worn. Preferably, the pads are disposed near the tops 35 and 45 and bottoms 37 and 47 of the trim cylinder units 30 and 40 respectively.

The trim and tilt cylinder apparatus 22 also includes a hydraulic reservoir 60 and a pumping unit 62 which together provide hydraulic fluid to the tilt cylinder unit 24 and the trim cylinder units 30 and 40. The reservoir 60, the pumping unit 62, the tilt cylinder unit 24, and the trim cylinder units 30 and 40 form a hydraulic circuit. During operation of the trim and tilt apparatus 22 hydraulic fluid is pumped into and out of the tilt cylinder 26 and the trim cylinders 32 and 42 in order to move the propulsion unit 12, which is shown in FIG. 1, between the lower position and the upper position.

Figure 3:
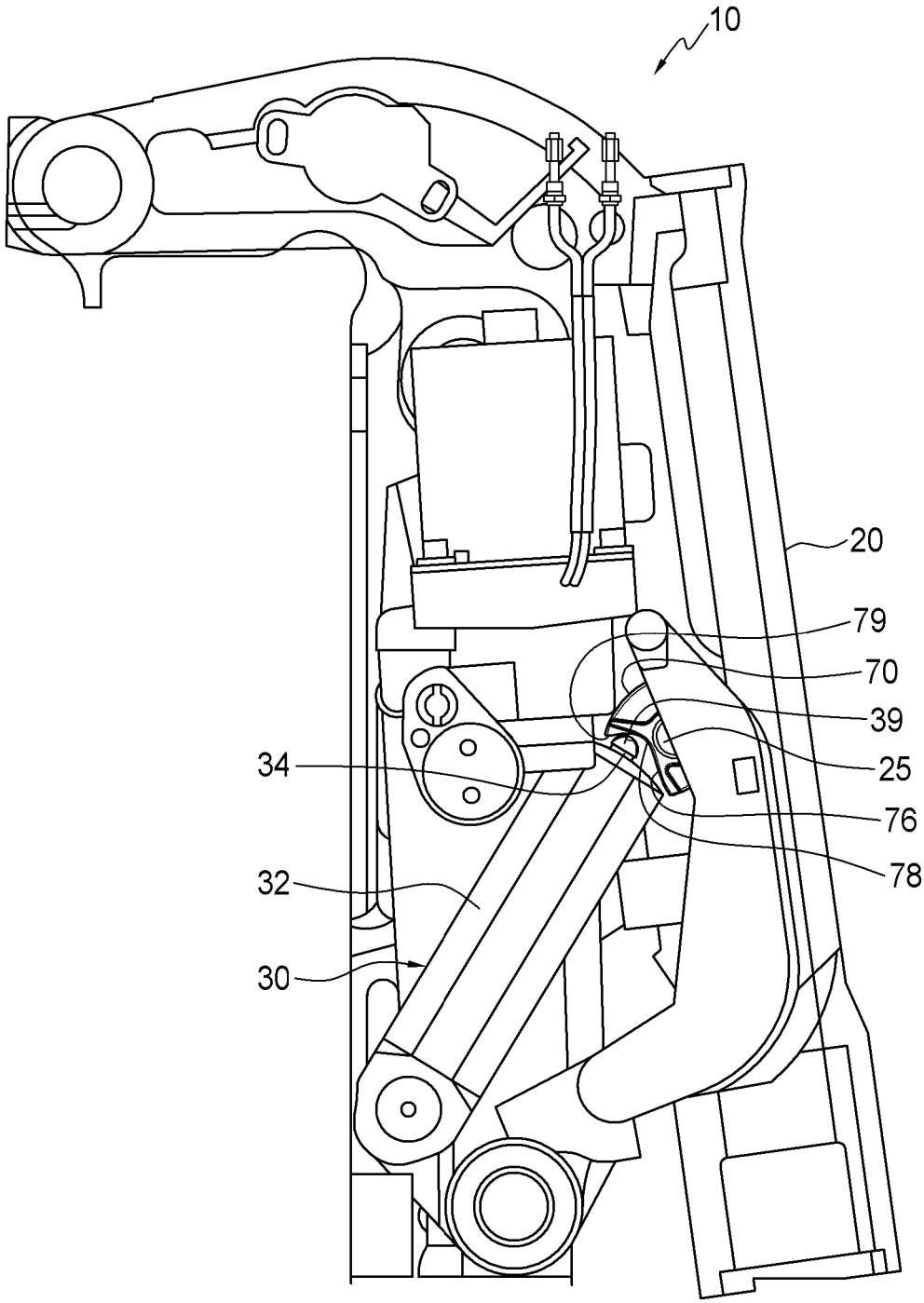
FIG. 3 is a side view of the trim and tilt system of FIG. 1 shown in a lower position.
Figure 4:
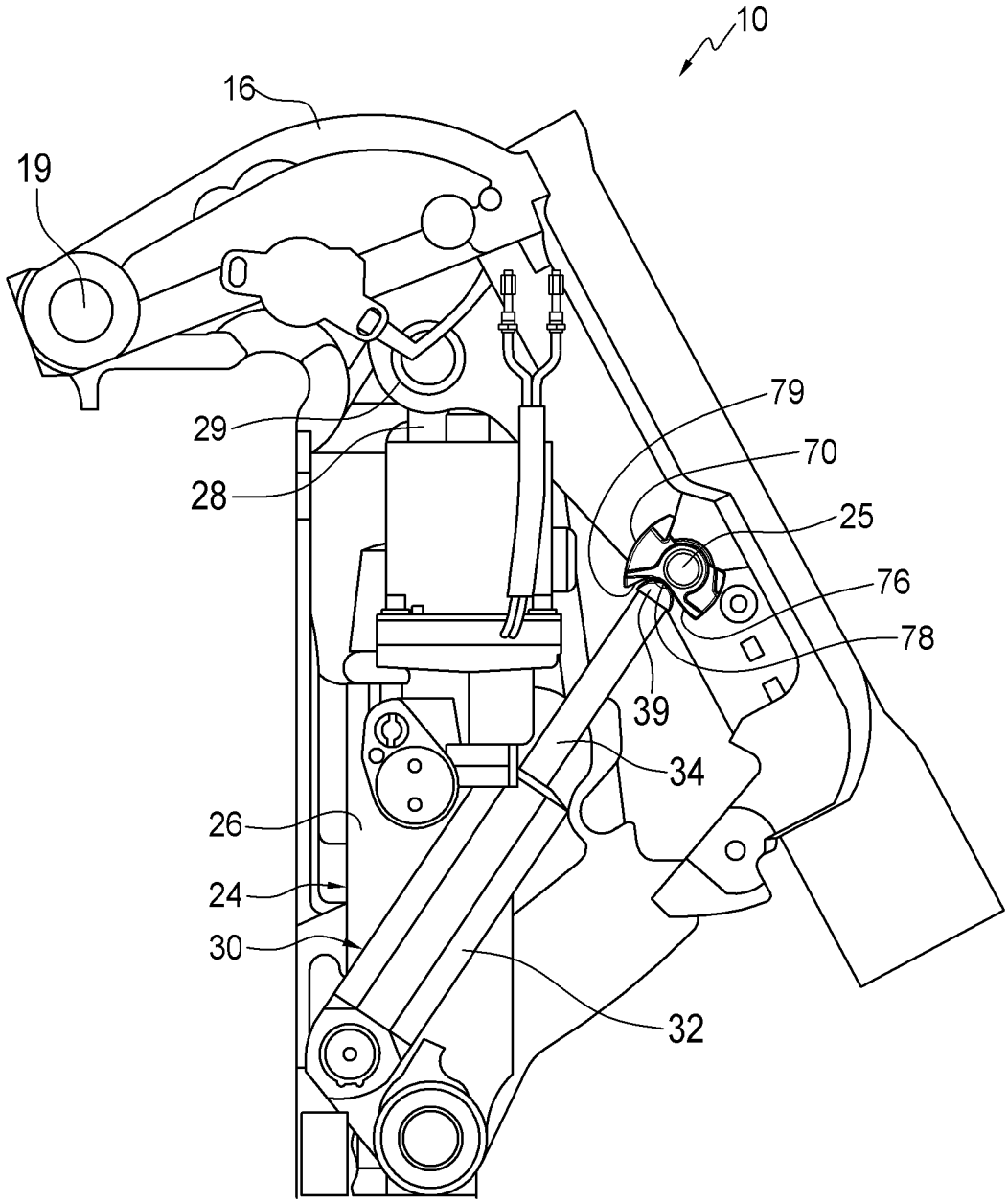
FIG. 4 is a side view of the trim and tilt system of FIG. 1 shown in an intermediate position.
Figure 5:
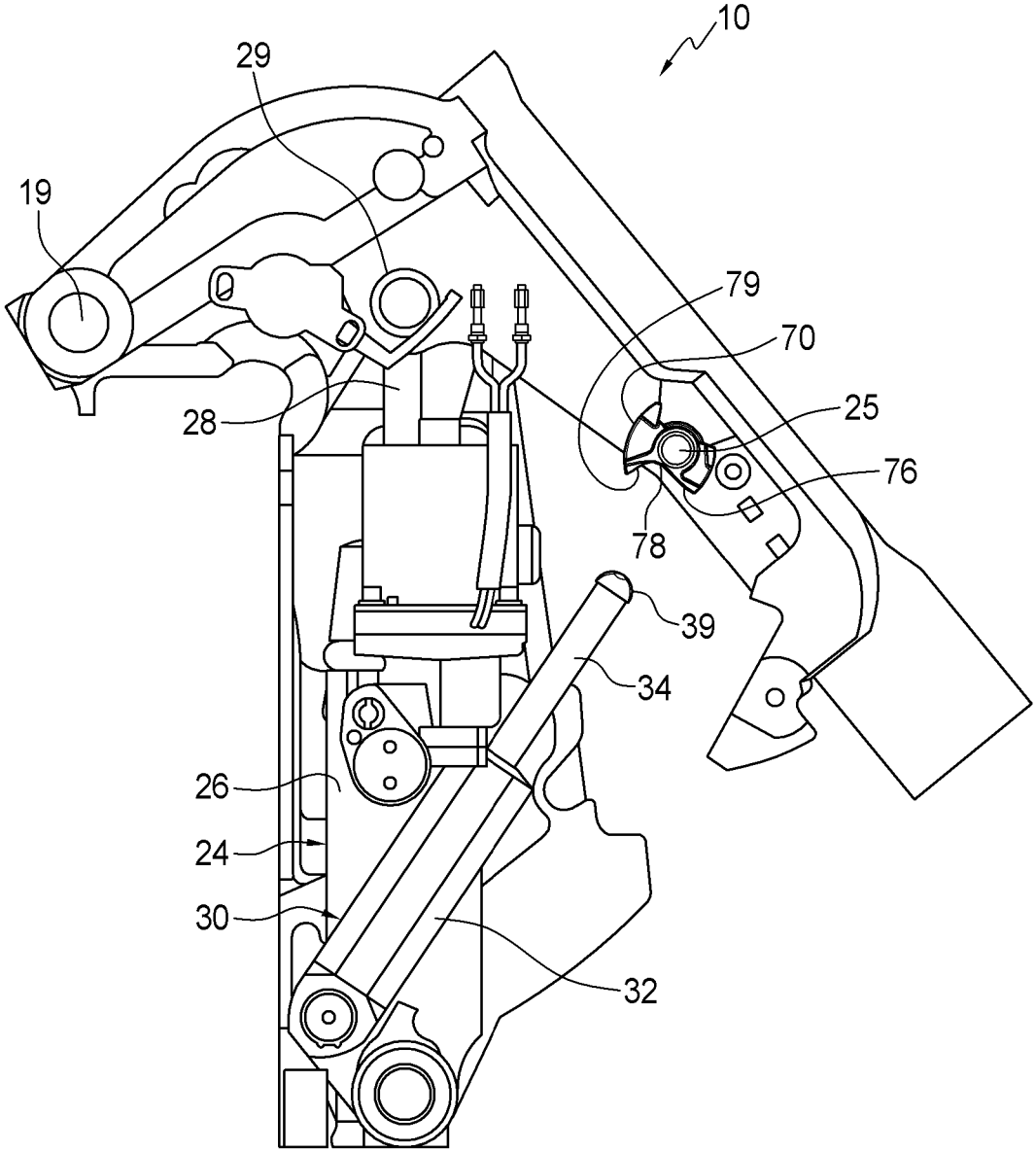
FIG. 5 is a side view of the trim and tilt system of FIG. 1 in show in an upper position.
Figure 6:
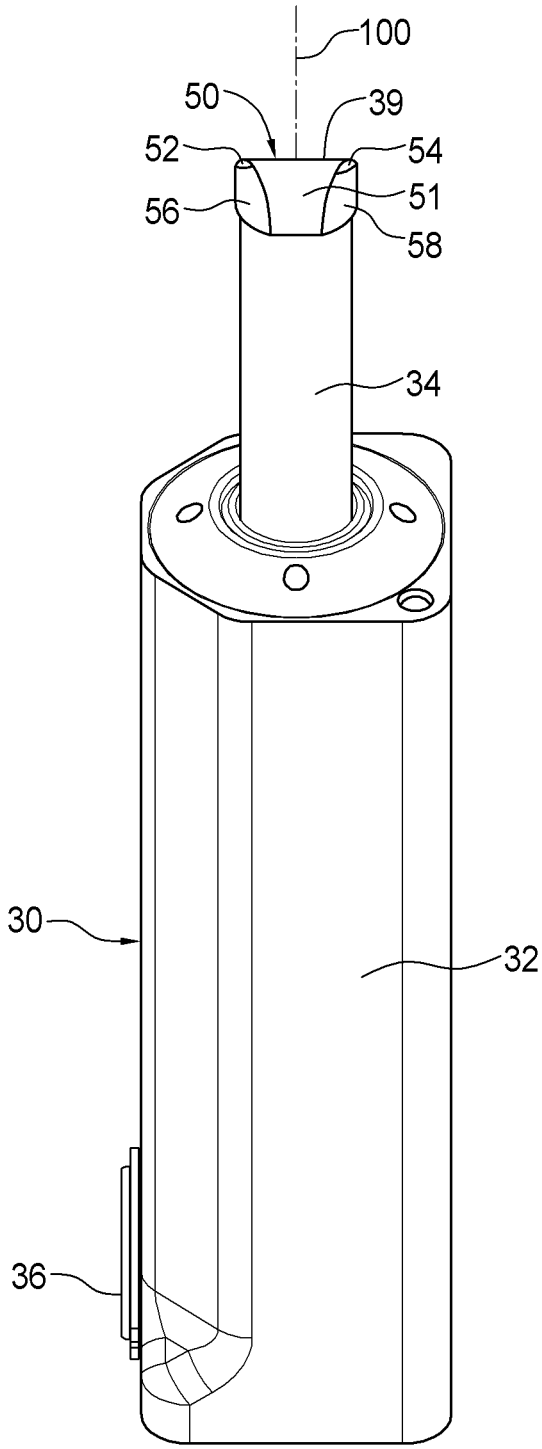
FIG. 6 is a perspective view of a trim cylinder unit of the trim and tilt cylinder apparatus FIG. 2.

Referring now to FIGS. 3 to 5, the trim and tilt system 10 further includes a pair of trim receivers, each of which is configured to receive the trim rod of a corresponding one of the trim cylinder units. However, only one of the trim receivers 70, which receives the trim rod 34 of the first trim cylinder unit 30, is shown in the drawings. The trim receiver 70 is rotatably mounted on the swivel bracket 20. The other trim receiver (not shown) is also rotatably mounted on the swivel bracket 20 and receives the trim rod 44 of the second trim cylinder unit 40. The trim receivers are mirror images of one another with like parts which function in a like manner. Accordingly, only the trim receiver 70 shown in the drawings is described in detail herein.

Figure 10:
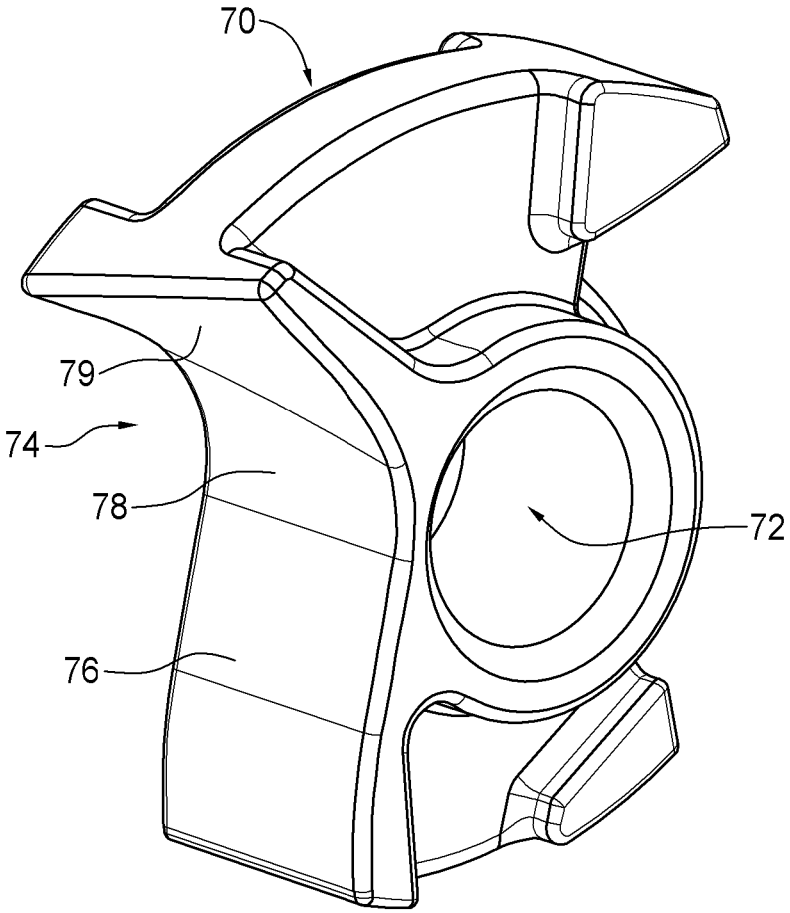
FIG. 10 is a perspective view of a trim receiver of the trim and tilt cylinder system of FIG. 1.
Figure 11:
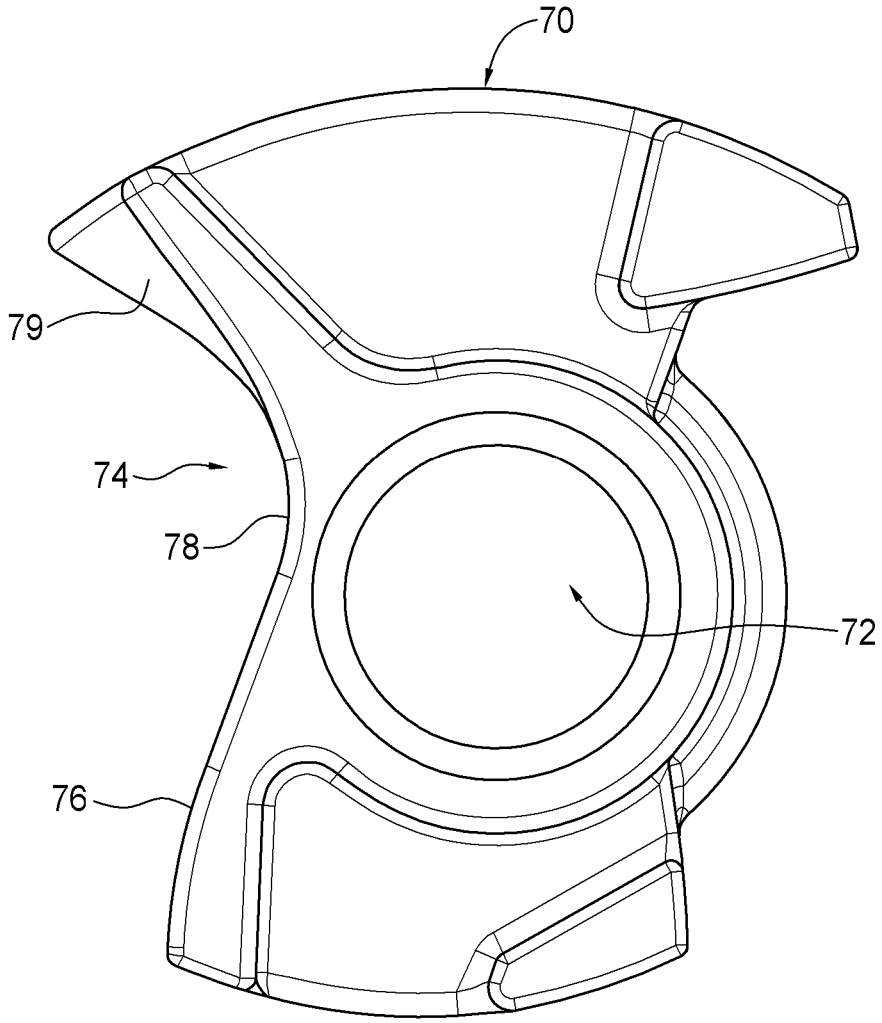
FIG. 11 is a side elevation view of the trim receiver of FIG. 10.

The trim receiver 70 is best shown in FIGS. 10 and 11. In this example, the trim receiver 70 has bore 72 which allows the trim receiver 70 to be rotatably mounted about a cylindrical projection or shaft 25 on the swivel bracket 20 as shown in FIGS. 3 to 5. However, in other embodiments other means may be used to rotatably or pivotally connect the trim receiver to the swivel bracket. Referring back to FIGS. 10 and 11, the trim receiver 70 has a concave receptacle 74 for receiving the piston rod 34 of the first trim cylinder unit 30. The receptacle 74 has a three-dimensional, curved surface 76 which defines a vertex 78 of the receptacle 74. The curved surface 76 may be a hyperboloid or paraboloid surface, or other such surface. As best shown in FIGS. 3 to 5, when the trim receiver 70 is mounted on the swivel bracket 20, at least a portion 79 of the curved surface 76 faces laterally outward of the swivel bracket 20.

In operation, when the propulsion unit 12 is in the lower position, the tilt rod 28 is substantially disposed within the tilt cylinder 26 as best shown in FIG. 2. The trim rods 34 and 44 are also substantially disposed within the trim cylinders 32 and 42 as shown in FIG. 2. This is also shown in FIG. 3 for the first trim cylinder unit 30.

To move the propulsion unit 12 from the lower position to the upper position, the pumping unit 62 is operated to pump hydraulic fluid from the reservoir 60 into the bottoms of the tilt cylinder 26 and both of the trim cylinders 32 and 42. As shown in FIG. 4, this causes the tilt rod 28 to extend from the tilt cylinder 26 and pivot the swivel bracket 20 upwards about the pivotal connection 19 between the swivel bracket 20 and the stern bracket 14. The trim rods 34 and 44 also extend from the trim cylinders 32 and 42. As shown in FIG. 4, for the first trim cylinder unit 30, this causes the distal end 39 the trim rod 34 to come into operative engagement with the corresponding trim receiver 70. The trim cylinder units 30 and 40 thereby also act pivot the swivel bracket 30 upwards. This phase of the operation is considered the trimming phase during which an operator is able to set a running position of the propulsion unit 12.

The trimming phase ends when the trim rods 34 and 44 are fully extended out of the trim cylinders 32 and 42. After the trim rods 34 and 44 are fully extended, the tilt rod 28 may continue to extend out of the tilt cylinder 26 and pivot the swivel bracket 20 upwards. As shown in FIG. 5, for the first trim cylinder unit 30, this causes the trim receiver 70 to move away from the trim rod 34. The swivel bracket 20 continues to pivot upwards until the tilt rod 28 is fully extended out of the tilt cylinder 26. This phase of the operation is considered the tilting phase during which an operator is able to bring the propulsion unit 12 out of the surrounding water.

Considering now the opposite motion, to move the propulsion unit 12 from the upper position to the lower position, the pumping unit 62 is operated to pump hydraulic fluid from the reservoir 60 into the top of the tilt cylinder 26. This causes the tilt rod 28 to retract into the tilt cylinder 26 and pivot the swivel bracket 20 downwards about the pivotal connection 19 between the swivel bracket 20 and the stern bracket 14. Eventually the trim receivers 70 come into operative engagement with the trim rods 34 and 44. The weight of the propulsion unit 12 exerts a force on the trim rods 34 and 44, causing the trim rods to retract into the trim cylinders 32 and 42. The swivel bracket 20 continues to pivot downwards until the tilt rod 28 and both of the trim rods 34 and 44 are fully retracted into their respective cylinders 32 and 42.

The trim receivers disclosed herein provide the advantage of allowing the trim rods 34 and 44 to self-align therewith. Accordingly, when the propulsion unit 12 is moved between lower and upper positions, the force exerted by the propulsion unit 12 on the trim rods 34 and 44 is substantially along the longitudinal axes of the trim rods 34 and 44. This minimizes the stress put on the trim cylinder units 30 and 40 as the propulsion unit 12 is moved between the lower and the upper positions. It also allows the trim cylinder units 30 and 40 to handle greater loads.

When the rounded distal ends of the trim rods 34 and 44 come in to engagement with the trim receivers 70, the curved surface 76 of the receptacle 74 guides the rounded distal ends of the trim rods 34 and 44 towards the vertex 78 of the receptacle 74. This is facilitated, at least in part, by the pivotable and/or rotatable disposition of the trim cylinder units 30 and 40 and the trim receivers 70. The trim rods 34 and 44 are thereby able to substantially self-align with the trim receivers 70. Furthermore, once the trim rods 34 and 44 are aligned with the trim receivers 70, the chamfers on the 52 and 54 on the rounded distal ends of the trim rods 34 and 44 prevent the trim rods 34 and 44 from skewing outwards of the trim receivers 70, thereby ensuring lateral stability.

If the trim rods 34 and 44 are misaligned with the trim receivers, the chamfers 52 and 54 on the rounded distal ends of the trim rods 34 and 44 engage with the portion 79 of the curved surface 76 of the receptacle which faces laterally outward of the swivel bracket 20. The non-aligned, off center position of the chamfers 52 and 54 allow the trim rods 34 and 44 to twist out and thereby provide a restorative moment which brings the trim rods 34 and 44 into alignment. As shown in the Table 1 below, the present invention allows misaligned trim rods to self-align within approximately two strokes.

TABLE 1

Experimental Data Showing the Strokes Required for a Trim Rod to Self-Align

| Degree of Misalignment | Strokes Required for a Trim Rod to Self-Align |
|---|---|
| 45° | less than half a stroke |
| 90° | approximately one stroke |
| 105° | approximately two strokes |
| 120° | Less than half a stroke |

It will be understood by a person skilled in the art that the terms "top", "bottom", "upwards", and "downwards" as used herein, are used in only in relation to positions and directions as shown in the Figures.

It will be further understood by a person skilled in the art that many of the details provided above are by way of example only and are not intended to limit the scope of the invention which is to be determined with reference to the following claims.

What is claimed is:

1. A trim and tilt system for use with a propulsion unit mounted on a marine craft, the trim and tilt system comprising:

a stern bracket for mounting the trim and tilt system on the marine craft;

a swivel bracket for supporting the propulsion unit, the swivel bracket being pivotally connected to the stern bracket;

a tilt cylinder unit including a tilt cylinder and a tilt rod reciprocatingly received by the tilt cylinder, the tilt rod being connected to the swivel bracket;

a trim cylinder unit including a trim cylinder and a trim rod reciprocatingly received by the tilt cylinder, the trim cylinder unit being pivotably coupled to the tilt cylinder unit and the trim rod having a rounded distal end and at least one chamfer at a distal end thereof; and a trim receiver mounted on the swivel bracket, the trim receiver having a curved three dimensional surface which is at least part of a hyperboloid surface for receiving and applying a force on the trim rod, wherein the trim rod is able to substantially self-align with the trim receiver.

2. The trim and tilt system as claimed in claim 1 wherein the trim receiver is rotatably mounted on the swivel bracket.

3. The trim and tilt system as claimed in claim 1 wherein the trim receiver is pivotably mounted on the swivel bracket.

4. The trim and tilt system as claimed in claim 1 including a pair of spaced apart chamfers.

5. A trim and tilt system for use with a propulsion unit mounted on a marine craft, the trim and tilt system comprising:

a stern bracket for mounting the trim and tilt system on the marine craft;

a swivel bracket for supporting the propulsion unit, the swivel bracket being pivotally connected to the stern bracket;

a tilt cylinder unit including a tilt cylinder and a tilt rod reciprocatingly received by the tilt cylinder, the tilt rod being connected to the swivel bracket;

a trim cylinder unit including a trim cylinder and a trim rod reciprocatingly received by the tilt cylinder, the trim cylinder unit being pivotably coupled to the tilt cylinder unit and the trim rod having a distal end, the distal end of the trim rod having a rounded surface which tapers towards the trim cylinder and pair of spaced apart chamfers; and a trim receiver rotatably mounted on the swivel bracket, the trim receiver having a curved three dimensional surface which is at least part of a hyperboloid surface for receiving and applying a force on the trim rod, wherein the trim rod is able to substantially self-align with the trim receiver.

6. A trim and tilt system for use with a propulsion unit mounted on a marine craft, the trim and tilt system comprising:

a stern bracket for mounting the trim and tilt system on the marine craft;

a swivel bracket for supporting the propulsion unit, the swivel bracket being pivotally connected to the stern bracket;

a tilt cylinder unit including a tilt cylinder and a tilt rod reciprocatingly received by the tilt cylinder, the tilt rod being connected to the swivel bracket;

a trim cylinder unit including a trim cylinder and a trim rod reciprocatingly received by the tilt cylinder, the trim cylinder unit being pivotably coupled to the tilt cylinder unit and the trim rod having a rounded distal end and at least one chamfer at a distal end thereof; and a trim receiver mounted on the swivel bracket, the trim receiver having a curved three dimensional surface which is at least part of a paraboloid for receiving and applying a force on the trim rod, wherein the trim rod is able to substantially self-align with the trim receiver.

7. The trim and tilt system as claimed in claim 6 wherein the trim receiver is rotatably mounted on the swivel bracket.

8. The trim and tilt system as claimed in claim 6 wherein the trim receiver is pivotably mounted on the swivel bracket.

9. The trim and tilt system as claimed in claim 6 including a pair of spaced apart chamfers.

10. A trim and tilt system for use with a propulsion unit mounted on a marine craft, the trim and tilt system comprising:

a stern bracket for mounting the trim and tilt system on the marine craft;

a swivel bracket for supporting the propulsion unit, the swivel bracket being pivotally connected to the stern bracket;

a tilt cylinder unit including a tilt cylinder and a tilt rod reciprocatingly received by the tilt cylinder, the tilt rod being connected to the swivel bracket;

a trim cylinder unit including a trim cylinder and a trim rod reciprocatingly received by the tilt cylinder, the trim cylinder unit being pivotably coupled to the tilt cylinder unit and the trim rod having a distal end, the distal end of the trim rod having a rounded surface which tapers towards the trim cylinder and pair of spaced apart chamfers; and a trim receiver rotatably mounted on the swivel bracket, the trim receiver having a curved three dimensional surface which is at least part of a paraboloid for receiving and applying a force on the trim rod, wherein the trim rod is able to substantially self-align with the trim receiver.

* * * * *